United States Patent [19]

Inokuti et al.

[11] Patent Number: 4,469,533

[45] Date of Patent: Sep. 4, 1984

[54] METHOD OF PRODUCING GRAIN ORIENTED SILICON STEEL SHEETS OR STRIPS HAVING HIGH MAGNETIC INDUCTION AND LOW IRON LOSS

[75] Inventors: Yukio Inokuti; Yo Ito, both of Chiba; Hiroshi Shimanaka, Funabashi, all of Japan

[73] Assignee: Kawasaki Steel Corporation, Kobe, Japan

[21] Appl. No.: 524,390

[22] Filed: Aug. 18, 1983

[30] Foreign Application Priority Data

Aug. 18, 1982 [JP] Japan ..... 57-142123
Mar. 24, 1983 [JP] Japan ..... 58-47931

[51] Int. Cl.[3] ..... H01F 1/04
[52] U.S. Cl. ..... 148/111; 148/112
[58] Field of Search ..... 148/110, 111, 112, 113

[56] References Cited

U.S. PATENT DOCUMENTS 3,855,020 12/1974 Salsgiver et al. ..... 148/111
3,959,033 5/1976 Barisoni et al. ..... 148/112

*Primary Examiner*—John P. Sheehan
*Attorney, Agent, or Firm*—Balogh, Osann, Kramer, Dvorak, Genova & Traub

[57] ABSTRACT

Grain oriented silicon steel sheets or strips having high magnetic induction and ultra-low iron loss can be obtained by the intermediate annealing cycle containing a rapid heating and rapid cooling just before final cold rolling, wherein a first cold rolled sheet is rapidly heated from 500° C. to 900° C. at a heating rate of at least 50° C./sec and the steel sheet heated in the intermediate annealing is rapidly cooled from 900° C. to 500° C. at a cooling rate of at least 5° C./sec.

7 Claims, 4 Drawing Figures

(a) —— Intermediate Annealing Cycle Containing the Rapid Heating and Rapid Cooling according to the Present Invention (b) ---- Conventional Intermediate Annealing Cycle

METHOD OF PRODUCING GRAIN ORIENTED SILICON STEEL SHEETS OR STRIPS HAVING HIGH MAGNETIC INDUCTION AND LOW IRON LOSS

BACKGROUND OF THE INVENTION (1) Field of the Invention:

The present invention relates to a method of producing grain oriented silicon steel sheets or strips having high magnetic induction and low iron loss, and more particularly the present invention provides a method of producing grain oriented silicon steel sheets or strips having high magnetic induction and low iron loss, wherein an intermediate annealing is carried out under a particular condition based on the result on the investigation of the behavior of silicon steel sheets in the intermediate annealing as a means for improving surely, stably and advantageously the above described two magnetic properties.

(2) Description of the Prior Art:

Grain oriented silicon steel sheets are mainly used in the iron cores of a transformer and other electric instruments, and are required to have such excellent magnetic properties that the magnetic induction represented by $B_{10}$ value is high and the iron loss represented by $W_{17/50}$ is low.

Particularly, it is necessary to satisfy the following two requirements in order to improve the magnetic properties of grain oriented silicon steel sheets. Firstly, it is necessary to arrange the highly aligned <001> axis of secondary recrystallized grains in the steel sheet uniformly in the rolling direction, and secondary to make the amount of impurities and precipitates remained in the final product as few as possible.

In order to satisfy the requirements, a fundamental production method of grain oriented silicon steel sheets through a two-stage cold rolling was firstly proposed by N. P. Goss, and various improved methods thereof have been proposed, and the magnetic induction of grain oriented silicon steel sheet is higher and the iron loss thereof is lower year after year. Among the improved methods, typical methods are a method disclosed in Japanese Patent Application Publication No. 15,644/65, wherein the finely precipitated AlN is used (hereinafter, referred to the former method), and a method disclosed in Japanese Patent Application Publication No. 13,469/76, wherein a mixture of Sb and Se or Sb and S as inhibitors is used (hereinafter, referred to the latter method). In these methods, a product having a $B_{10}$ value higher than 1.89 can be obtained.

It has been known that, in the former method of Japanese Patent Application Publication No. 15,644/65, wherein the finely precipitated AlN is used, a product having high magnetic induction can be obtained, but its iron loss is relatively high due to the large secondary recrystallized grains after final annealing. Recently, an improved method has been proposed in Japanese Patent Application Publication No. 13,846/79, wherein the inter-pass aging is carried out during the course of cold rollings at high reduction rate to form the secondary recrystallized grains with the small sizes and thereby to decrease the iron loss. According to this method, products having an iron loss $W_{17/50}$ lower than 1.05 W/kg can be obtained. However, the iron loss is not satisfactorily low as compared with the high magnetic induction. In order to obviate the above described drawbacks, a method for decreasing the iron loss of grain oriented silicon steel sheet has quite recently been disclosed in Japanese Patent Application Publication No. 2,252/82, wherein laser beams are irradiated on the surface of a final product steel sheet at an interval of serval mm in substantially the rectangular direction with respect to the rolling direction to introduce artificial grain boundary on the steel sheet surface. However, this method for introducing the artificial grain boundary forms locally a high dislocation density area, and therefore the resulting product has such a serious drawback that the product can only be used stably under a low temperature condition of not higher than 350° C.

While, the latter method of Japanese Patent Application Publication No. 13,469/76 is a method found out by the inventors. In this method also, a high magnetic induction of $B_{10}$ of at least 1.89 T can be obtined. However, in order to obtain a product having a higher magnetic induction, the inventors disclosed improved methods in Japanese Patent Laid-Open Specification No. 11,108/80, wherein Mo is added to the raw material silicon steel together with Sb and one of Se and S, and in Japanese Patent Laid-Open Specification No. 93,823/81, wherein Mo is added to the raw material silicon steel together with Sb and one of Se and S, and a steel sheet heated in the intermediate annealing just before the final cold rolling is subjected to a rapid cooling treatment, whereby a grain oriented silicon steel sheet concurrently having a high magnetic induction of $B_{10}$ of at least 1.92 and a low iron loss of $W_{17/50}$ of not higher than 1.05 W/kg is produced. However, this method is still insufficient for producing steel sheets having a satisfactorily low iron loss.

Since the energy crisis in several years ago, it has been eagerly demanded to develop grain oriented silicon steel sheets having an ultra-low electric power loss to be used as an iron core material.

In order to accomplish advantageously the above described demand, the inventors have investigated a method for improving advantageously the magnetic properties of a grain oriented silicon steel sheet by innovating the intermediate annealing method of the steel sheet.

SUMMARY OF THE INVENTION

An object of the present invention is to provide a method of producing stably grain oriented silicon steel sheets which are free from the above described various drawbacks and have high magnetic induction and low iron loss.

The feature of the present invention lies in a method of producing grain oriented silicon steel sheets having high magnetic induction and low iron loss, wherein a silicon steel slab having a composition consisting of 0.01–0.06% by weight (hereinafter, % relating to composition means % by weight) of C, 2.0–4.0% of Si, 0.01–0.20% of Mn, 0.005–0.1% in a total amount of at least one of S and Se, and the remainder being substantially Fe is hot rolled, the hot rolled sheet is subjected to a normalizing annealing and then subjected to at least two cold rollings with an intermediate annealing between them to produce a cold rolled sheet having a final gauge, and the cold rolled sheet is subjected to a primary recrystallization annealing concurrently effecting decarburization and then subjected to a final annealing to develop secondary recrystallized grains having {110}<001> orientation, an improvement comprising carrying out such rapid heating and rapid cooling treatments in the intermediate annealing that the heating from 500° C. to 900° C. of the first cold rolled sheet is carried out at a heating rate of at least 5° C./sec, and the cooling from 900° C. to 500° C. of the steel sheet heated in the intermediate annealing is carried out at a cooling rate of at least 5° C./sec.

In the above described method of the present invention, when a silicon steel slab having a composition consisting of 0.01–0.06% of C, 2.0–4.0% of Si, 0.01–0.20% of Mn, 0.005–0.1% in a total amount of at least one of S and Se, one of the following component groups (1)–(5), (1) 0.005–0.20% of Sb,
(2) 0.005–0.20% of Sb and 0.003–0.1% of Mo,
(3) 0.01–0.09% of acid-soluble Al and 0.001–0.01% of N,
(4) 0.01–0.09% of acid-soluble Al, 0.005–0.5% of Sn and 0.001–0.01% of N, and
(5) 0.0003–0.005% of B and 0.005–0.5% of Cu, and the remainder being substantially Fe, in used, grain oriented silicon steel sheets having more improved magnetic properties can be obtained.

DESCRIPTION OF THE PREFERRED EMBODIMENT

Figure 1:
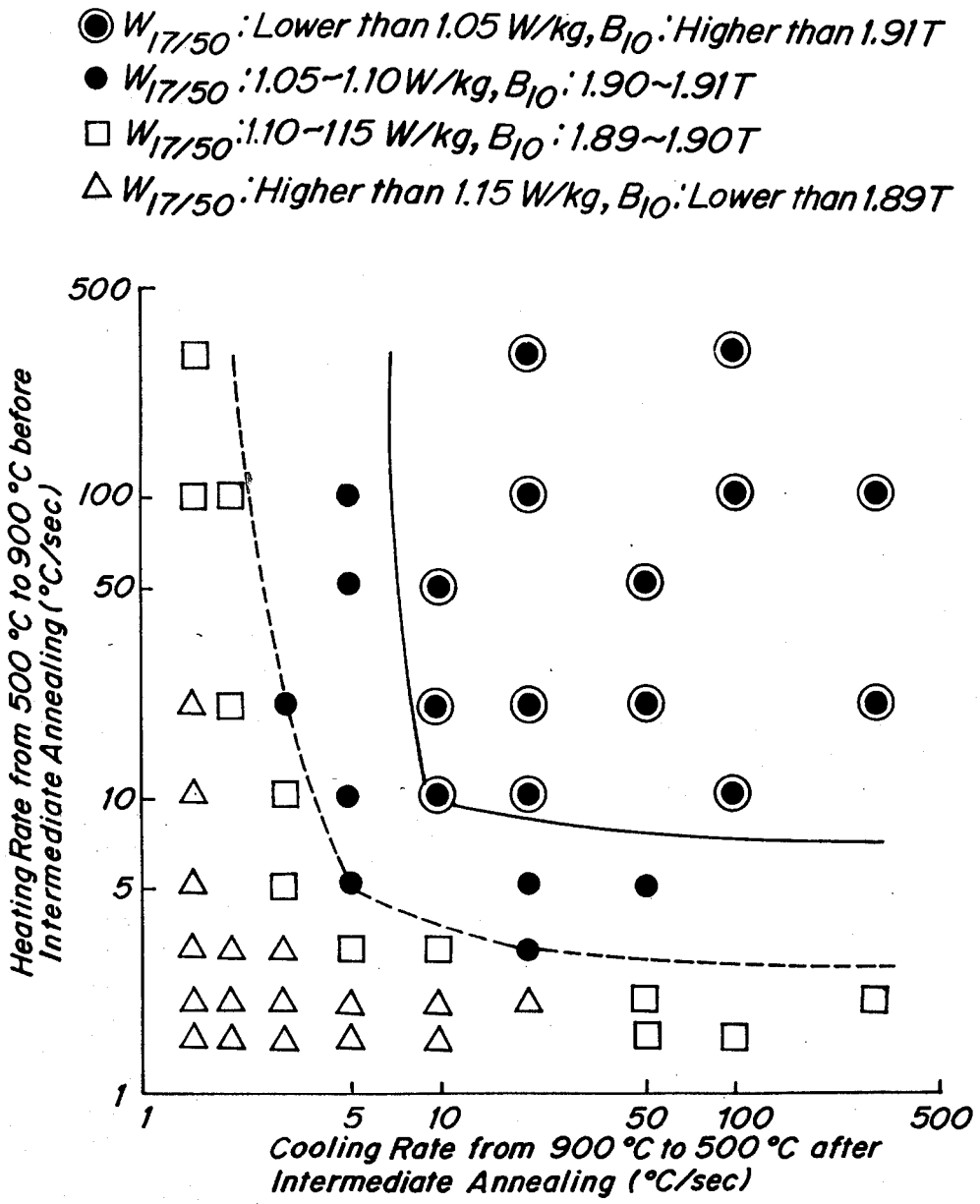
FIGS. 1, 2 and 3 illustrate the influence of the heating rate and cooling rate of a silicon steel sheet during an intermediate annealing upon the magnetic properties of the resulting grain oriented silicon steel sheet.

The present invention will be explained in more detail referring to experimental data.

The inventors have noticed that there is a certain limit in the magnetic properties of grain oriented silicon steel sheet produced by the heat treatment step carried out at present for producing grain oriented silicon steel sheet having high magnetic induction and ultra-low iron loss, and it is necessary to study again fundamentally the intermediate annealing cycle. Based on this idea, a pulse annealing furnace which can carry out a high speed heating and high speed cooling was newly constructed, and experiments were carried out. This pulse heat treating method is a method, wherein a specimen itself to be treated is moved at a high speed in a space between a plural number of radiation-heating zones and cooling zones, and the moving of the specimen is controlled to obtain an optional heat cycle as disclosed in Japanese Patent Application No. 20,880/81.

Each of the following steel slabs (A), (B) and (C): slab (A) having a composition consisting of C: 0.043%, Si: 3.36%, Mn: 0.068%, Se: 0.019%, Sb: 0.025%, and the remainder: Fe; slab (B) having a composition consisting of C: 0.040%, Si: 3.25%, Mn: 0.066%, S: 0.020%, and the remainder: Fe; and slab (C) having a composition consisting of C: 0.043%, Si: 3.35%, Mn: 0.065%, Se: 0.017%, Sb: 0.023%, Mo: 0.013%, and the remainder: Fe; was hot rolled into a thickness of 3.0 mm (steel (A)), 2.4 mm (steel (B)) or 2.7 mm (steel (C)) respectively, the hot rolled sheet was subjected to a normalizing annealing at 900° C. for 3 minutes and then subjected to a first cold rolling at a reduction rate of 70–75%, and the first cold rolled sheet was intermediately annealed by means of a pulse annealing apparatus.

This intermediate annealing was carried out at 950° C. for 3 minutes. Further, in this intermediate annealing, the heating and cooling of the steel sheet were effected in the following various conditions. That is, the heating of the first cold rolled sheet within the temperature range from 500° C. to 900° C. was effected at a heating rate of at least 1.5° C./sec, and the cooling within the temperature range from 900° C. to 500° C. of the steel sheet heated in the intermediate annealing was effected at a cooling rate of at least 1.5° C./sec. Such control of the heating and cooling rates can be easily carried out by previously fitting a thermocouple to a steel sheet sample and changing optionally the moving rate of the sample arranged in a pulse annealing furnace.

The intermediately annealed sheet by means of a pulse annealing apparatus was subjected to a second cold rolling at a reduction rate of about 60–65% to obtain a finally cold rolled sheet having a final gauge of 0.30 mm.

The finally cold rolled sheet was subjected to a decarburization and primary recrystallization annealing in wet hydrogen kept at 820° C., heated from 820° C. to 950° C. at a heating rate of 3° C./hr, and subjected to a purification annealing at 1,180° C. for 5 hours. The magnetic properties of each of the resulting grain oriented silicon steel sheets were plotted in rectangular coordinates, wherein the heating rate in the intermediate annealing was described in the ordinate, and the cooling rate therein was described in the abscissa, and are shown in FIG. 1 (steel (A)), FIG. 2 (steel (B)) and FIG. 3 (steel (C)), respectively.

Figure 2:
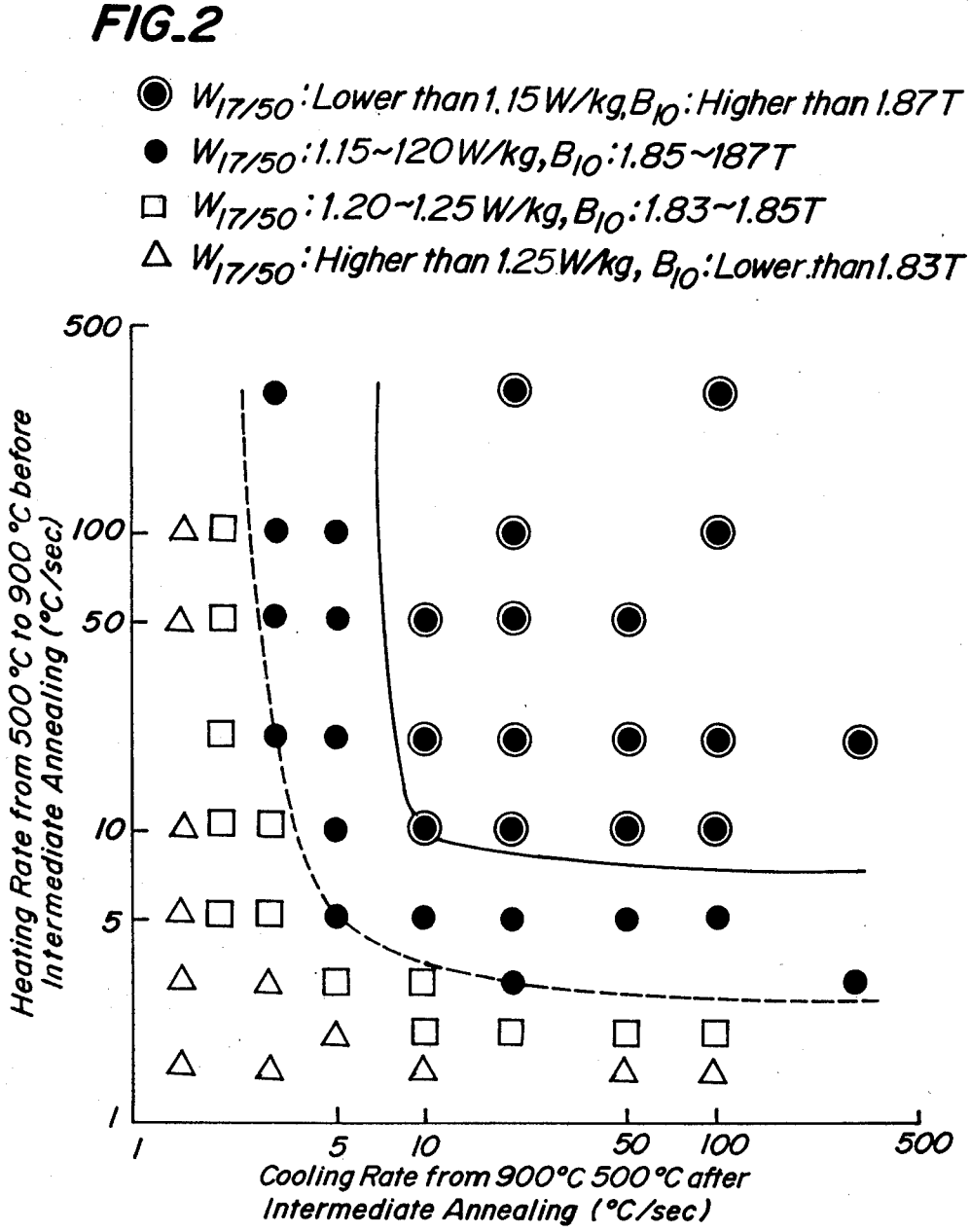
Figure 3:
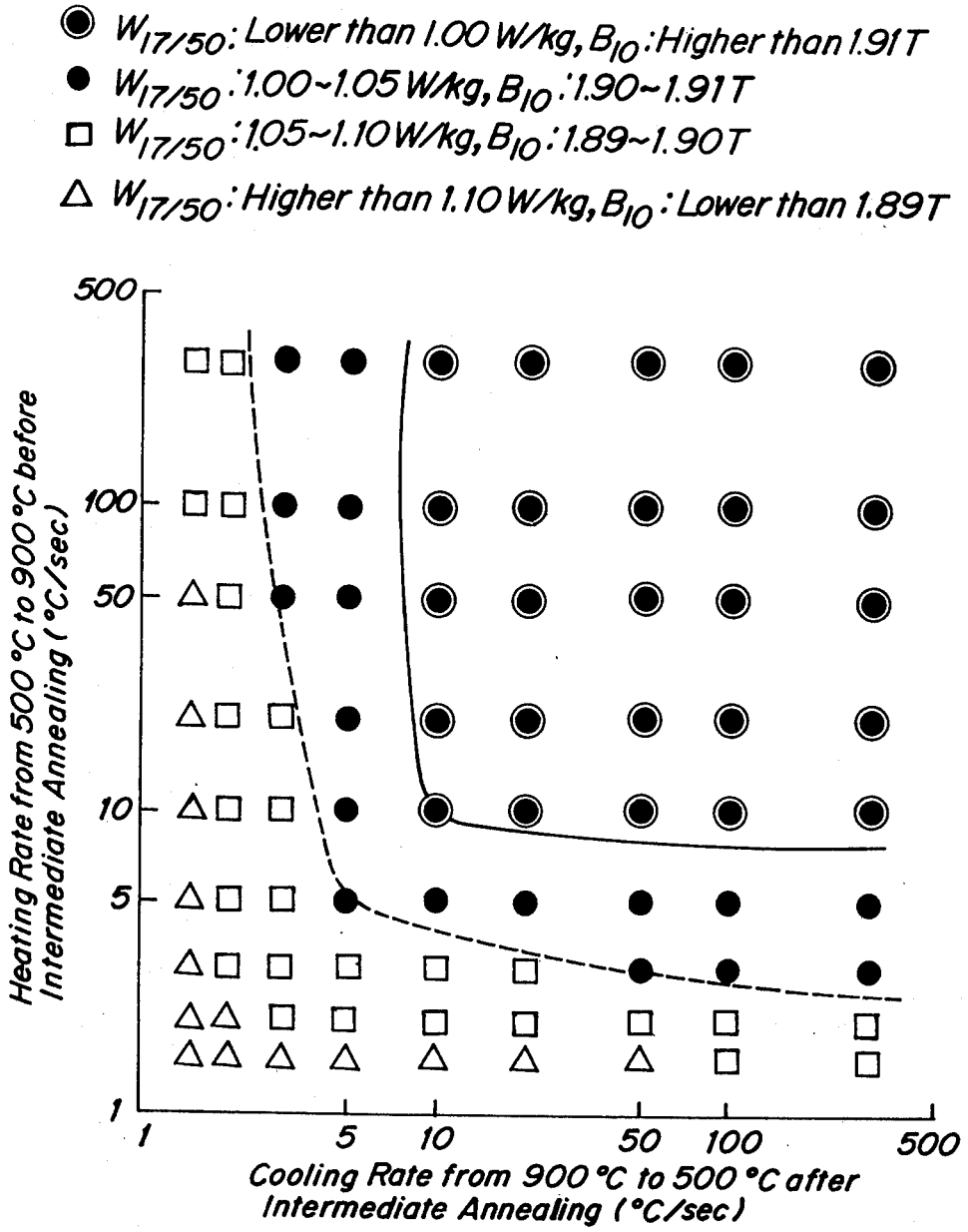

It can be seen from FIGS. 1, 2, and 3 that the magnetic properties of products are highly influenced by the intermediate annealing cycle, and when both the heating and cooling rates are at least 5° C./sec, preferably at least 10° C./sec, excellent magnetic properties can be obtained.

In the above described experiments of FIGS. 1 and 2, Se+Sb (steel (A)) or S (steel (B)) is used an inhibitor-forming element. It has been ascertained that the use of other inhibitor-forming element of Se or S+Sb can attain substantially the same effect as that in the use of Se+Sb or S.

It is noticeable that the use of steel (C) containing Se, Sb and Mo can produce grain oriented silicon steel sheets having a high magnetic induction of $B_{10}$ of at least 1.91 T and an ultra-low iron loss of $W_{17/50}$ of not more than 1.00 W/kg in the case where both the heating and cooling rates during the intermediate annealing are at least 10° C./sec as illustrated in FIG. 3. In this experiment of FIG. 3, although a steel containing Se, Sb and Mo is used, the use of S in place of Se, and the use of acid-soluble Al and N; acid-soluble Al, Sn and N; or B and Cu, in place of Sb and Mo can attain substantially the same effect as that in the use of Se, Sb and Mo.

Figure 4:
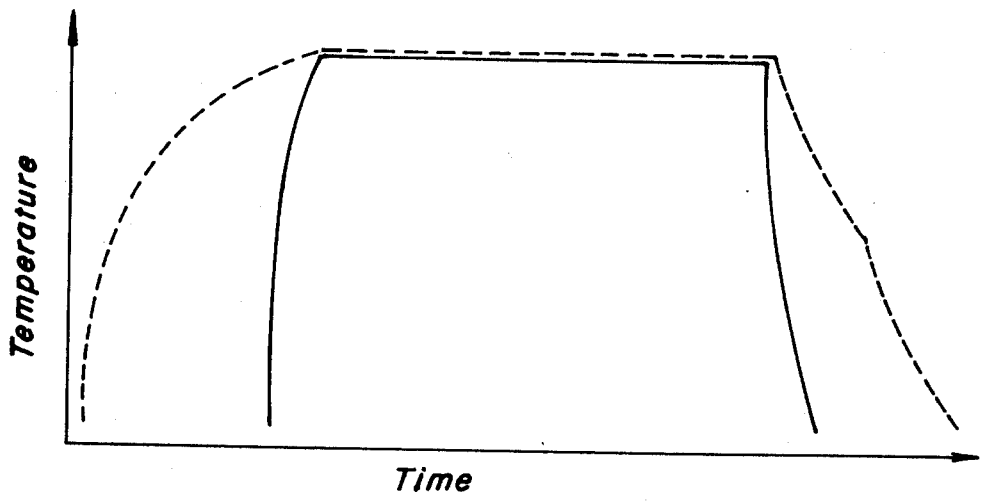
FIG. 4 shows a comparison of the intermediate annealing cycle containing the rapid heating and rapid cooling according to the present invention (solid line) with a conventional intermediate annealing cycle (broken line).

The inventors have already proposed a method for producing a grain oriented silicon steel sheet having good magnetic properties in Japanese Patent Laid-Open Specification No. 93,823/81, wherein a steel sheet heated in the intermediate annealing is rapidly cooled from 900° C. to 500° C. at a cooling rate of at least 5° C./sec. Further, the inventors have newly found out and disclosed in the present invention that, when a rapid heating treatment of a first cold rolled sheet in an intermediate annealing is combined with a rapid cooling treatment of the steel sheet heated in the intermediate annealing, grain oriented silicon steel sheets having very excellent magnetic properties can be obtained as illustrated in FIGS. 1, 2 and 3. That is, the inventors have newly found out that an intermediate annealing cycle containing a rapid heating and rapid cooling according to the present invention, which is shown by a solid line in FIG. 4, is more effective for developing secondary recrystallized grains having excellent magnetic properties than a conventional intermediate annealing cycle containing a gradual heating and gradual cooling shown by a broken line in FIG. 4.

Particularly, the rapid heating treatment in the intermediate annealing according to the present invention is carried out in order to promote the development of primary recrystallized grains closely aligned to {110}<001> orientation by heating a first cold rolled sheet at a high heating rate within the temperature range, which causes the recovery and recrystallization during the course of intermediate annealing. The first cold rolled sheet has many crystal grains having a {111}<11$\bar{2}$> orientation changed during the first cold rolling from elongated and polygonized grains, which have been developed in the vicinity of the steel sheet surface during the hot rolling of a slab and are closely aligned to {110}<001> orientation. In general, the nucleation of primary recrystallized grains in a cold rolled sheet of iron or iron alloy takes place in the order of {110}, {111}, {211} and {100} orientations as disclosed by W. B. Hutchinson in Metal Science J., 8 (1974), p. 185. Therefore, in a first cold rolled sheet of grain oriented silicon steel sheet also, the primary recrystallization treatment of the rapid heating in the intermediate annealing is probably more advantageous for developing recrystallization structure having 55 110}<001> orientation than the primary recrystallization treatment of the gradual heating.

Futher, in a series of investigations from the stage of hot rolled sheet to the initial stage of secondary recrystallization by the use of a transmission Kossel method {which investigations are Inokuti, Maeda, Itō and Shimanaka, Tetsu to Hagane, 68 (1982), p. S 545; The sixth International Conference on Textures of Materials, (1981), p. 192 (Japan); and Y. Inokuti et al, 1st Risø International Symposium on Metallurgy and Materials Science, (1980), p. 71 (Denmark)}, it has been disclosed that the nuclei of secondary recrystallized grains having {110}<001> orientation in a grain oriented silicon steel sheet develop in the vicinity of the steel sheet surface due to the structure memory from the hot rolled sheet. Therefore, it can be thought that, when the vicinity of the surface of grain oriented silicon steel sheet is rapidly heated in a high heating rate in an intermediate annealing just after the first cold rolling, primary recrystallized grains aligned to {110}<001> orientation can be predominantly developed, and hence secondary recrystallized grains aligned to {110}<001> orientation can be selectively developed during the secondary recrystallization annealing.

The rapid cooling treatment following to the intermediate annealing is effective for improving the magnetic properties of grain oriented silicon steel sheet in the present invention similarly to the invention disclosed in the above described Japanese Patent Laid-Open Specification No. 93,823/81. That is, when the precipitates are finely and uniformly distributed in a steel sheet before the second cold rolling of the steel sheet, the precipitates acts more effective as a barrier against the moving of dislocation at the cold rolling, and increases local volume of dislocation, and hence very fine and uniform cell structures are formed. As the result, during the primary recrystallization annealing which effects concurrently the decarburization, the structure components occurring at an early stage of recrystallization, that is, cells having {110}<001> or {111}<112> orientation are predominantly recrystallized. On the other hand, <011> fiber structure component, which restrains the development of secondary recrystallized grains having Goss orientations, such as {100}<011>, {112}<011>, {111}<011> orientations and the like, is difficult to be formed into cell, and at the same time is slow in the recrystallization, and therefore such unfavorable structure component can be decreased.

The conventional intermediate annealing in the two stage cold rolling, which was initially found out by N. P. Goss, has been carried out in order to improve crystallization texture having {100}<001> or {100}<011> orientation. On the contrary, the intermediate annealing cycle containing a rapid heating and rapid cooling of the present invention, which is shown by a solid line in FIG. 4, is an annealing cycle directing to an effective utilization of crystallization texture formed in the vicinity of the surface of hot rolled sheet and being closely aligned to {110}<001> orientation rather than directing to the improvement of the above described crystallization texture. When this treatment is effected, a large number of nuclei of secondary recrystallized grains aligned to {110}<001> orientation can be developed, and therefore the secondary recrystallized grains with the small sizes aligned to {110}<001> orientation can be directly developed from these nuclei in the secondary recrystallization annealing carried out in the later step, and grain oriented silicon steel sheets having an ultra-low iron loss can be obtained.

As seen from the above described explanation of the present invention comparing with the conventional technics, the intermediate annealing method containing the rapid heating and rapid cooling of the present invention is fundamentally different in the technical idea from the conventional technics, and is remarkably superior in the effect to the conventional technics.

The following explanation will be made with respect to the reason for limiting the composition of the slab to be used as a starting material in the present invention.

When the C content is lower than 0.01%, it is difficult to control the hot rolled texture during and after hot rolling not to form large and elongted grains. Therefore, the resulting grain oriented silicon steel sheet is poor in the magnetic properties. While, when the C content is higher than 0.06%, a long time is required for the decarburization in the decarburization annealing step, and the operation is expensive. Accordingly, the C content must be within the range of 0.01–0.06%.

When the Si content is lower than 2.0%, the product steel sheet is low in the electric resistance and has a high iron loss value due to the large eddy current loss. While, when the Si content is higher than 4.0%, the product steel sheet is brittle and is apt to crack during the cold rolling. Accordingly, the Si content must be within the range of 2.0–4.0%.

Mn is an important component for forming an inhibitor of MnS or MnSe, which has a high influence upon the development of secondary recrystallized grains of grain oriented silicon steel sheet. When the Mn content is lower than 0.01%, a sufficient inhibiting effect of MnS or the like necessary for developing secondary recrystallized grains is not displayed. As the result, secondary recrystallization is incomplete and at the same time the surface defect called as blister increases. While, when the Mn content exceeds 0.2%, the dissociation and solid solving of MnS or the like are difficult during the heating of slab. Even when the dissociation and solid solving of MnS or the like would occur, the coarse inhibitor is apt to be precipitated during the hot rolling of the slab, and hence MnS or the like having an optimum size distribution desired as an inhibitor is not formed, and the magnetic properties of the product steel sheet are poor. Accordingly, the Mn content must be within the range of 0.01–0.2%.

S and Se are equivalent component with each other, and each of S and Se is preferably used in an amount of not larger than 0.1%. Particularly, S is preferably used in an amount within the range of 0.008–0.1%, and Se is preferably used in an amount within the range of 0.003–0.1%. Because, when the S or Se content exceeds 0.1%, the steel sheet is poor in the hot and cold workabilities. While, when the S or Se content is lower than the lowest limit value, a sufficient inhibitor of MnS or MnSe for suppressing the growth of primary recrystallized grains is not formed. However, as already described in the experimental data, S and Se can be advantageously used in combination with commonly known inhibitors, such as Sb, Mo and the like, for the growth of primary grains, and therefore the lower limit value of each of S and Se can be 0.005% in the use in combination with Sb, Mo and the like. When S and Se are used in combination, the total content of S and Se must be within the range of 0.005–0.1% based on the same reason as described above.

Sb is effective for suppressing the growth of primary recrystallized grains. The inventors have already disclosed in Japanese Patent Application Publication No. 8,214/63 that the presence of 0.005–0.1% of Sb in a steel can suppress the growth of primary recrystallized grains, and in Japanese Patent Application Publication No. 13,469/76 that the presence of 0.005–0.2% of Sb in a steel in combination with a very small amount of Se or S can suppress the growth of primary recrystallized grains. When the Sb content is lower than 0.005%, the effect for suppressing the growth of primary recrystallized grains is poor. While, when the Sb content is higher than 0.2%, the product steel sheet is low in the magnetic induction, and is poor in the magnetic properties. Accordingly, the Sb content must be within the range of 0.005–0.2%.

Mo is effective for suppressing the growth of primary recrystallized grains by adding a small amount of up to 0.1% of Mo to silicon steel as disclosed by the inventors in Japanese Patent Laid-Open Specification No. 11,108/80. This effect can be also expected in the present invention. When the Mo content in a steel is higher than 0.1%, the steel is poor in the workability during the hot rolling and cold rolling, and further the product steel sheet is high in the iron loss. Therefore, the Mo content must be not higher than 0.1%. While, when the Mo content is lower than 0.003%, the growth of primary recrystallized grains cannot be satisfactorily suppressed. Accordingly, the Mo content in the steel must be within the range of 0.003–0.1%.

Sn is effective for creating the optimum particle size of AlN inhibitor. When Al is contained in a steel, the cold rolling can be carried out at a high reduction rate of not lower than 80%. However, in this case, AlN inhibitor is apt to be formed into the coarse particle size, and the inhibiting force of AlN is often poor and unstable. When a cold rolling at a high reduction rate of a steel sheet is carried out in the presence of 0.005–0.5% of Sn, the AlN inhibitor can be dispersed in a fine particle size, and a product steel sheet can be produced a stabler method.

As described above, the starting silicon steel of the present invention contains basically C: 0.01–0.06%, Si: 2.0–4.0%, Mn: 0.01–0.20%, and at least one of S and Se: 0.005–0.10% in total amount. When the steel further contains one of the following components, Sb: 0.005–0.20%; Sb: 0.005–0.20% and Mo: 0.003–0.1%; acid-soluble Al: 0.01–0.09% and N: 0.001–0.01%; acid-soluble Al: 0.01–0.09%, Sn: 0.005–0.5% and N: 0.001–0.01% and B: 0.0003–0.005% and Cu: 0.05–0.5%, products having the improved magnetic properties can be obtained. Particularly, when the steel further containing Sb and Mo; acid-soluble Al and N; acid-soluble Al, Sn and N; or B and Cu is subjected to an intermediate annealing cycle containing a rapid heating and rapid cooling of the present invention at a heating rate of at least 10° C./sec and at a cooling rate of at least 10° C./sec, product steel sheets having a high magnetic induction of $B_{10}$ of at least 1.91 T and an ultra-low iron loss of $W_{17/50}$ of not higher than 1.00 W/kg can be obtained. In the above described composition of starting silicon steel, when at least 0.01% of Al is used, the effect of Al appears without the use of S and/or Se, or Sb and Mo. However, Al can be used together with these elements.

Further, the silicon steel of the present invention may contain, in addition to the above elements, a very slight amount of publicly known elements ordinarily added to silicon steel, such as Cr, Ti, V, Zr, Nb, Ta, Co, Ni, P, As and the like.

The production step of the grain oriented silicon steel sheet of the present invention will be explained hereinafter.

The starting silicon steel ingot to be used in the present invention can be produced by means of an LD converter, electric furnace, open hearth furnace or other commonly known steel-making furnace. In these furnaces, vacuum treatment or vacuum dissolving may be also carried.

In the production of a slab from the steel ingot, a continuous casting method is carried out at present due to the reason that the continuous casting method has such economical and technical merits that grain oriented silicon steel sheets can be produced very inexpensively in a high yield and in a simple production step and that the resulting slab is uniform in the components arranged along the longitudinal direction of the slab and in the quality. Further, a conventional ingot making-slabbing method is advantageously carried out.

In the present invention, the elements, such as Sb, Mo and at least one of S and Se, can be added to starting material of molten steel by any of conventional methods, for example, to molten steel in an LD converter or to molten steel at the finished state of RH degassing or at the ingot making.

A continuously cast slab or a steel ingot is subjected to a hot rolling by a commonly known method. The thickness of the resulting hot rolled sheet is determined by depending upon the cold rolling, but, in general, is advantageously about 2–5 mm.

The hot rolled sheet is then subjected to a normalizing annealing and then to a cold rolling. The cold rolled sheet is heated before an intermediate annealing and cooled after an intermediate annealing. In this case, it is necessary that the heating and cooling are carried out at a high heating rate and at a high cooling rate in order to obtain products having the high magnetic induction and ultra-low iron loss as illustrated in FIGS. 1-3. That is, the heating rate within the temperature range from 500° C. to 900° C. of a cold rolled sheet to be heated before the intermediate annealing just before at least the final cold rolling must be controlled to at least 5° C./sec, and the cooling rate within the temperature range from 900° C. to 500° C. of the steel sheet heated in the intermediate annealing must be controlled to at least 5° C./sec.

This heating method before the intermediate annealing or cooling method after the intermediate annealing can be carried out by any of conventional methods. For example, when it is intended to raise rapidly the temperature by means of a conventional continuous furnace, the heating power of the heating zone of the continuous furnace is increased or an induction furnace is arranged on the heating zone area of the furnace so as to heat rapidly the cold rolled sheet. While, when the steel sheet heated in the intermediate annealing is intended to cool rapidly, a rapidly cooling installation, such as cooling gas jet or cooling water jet, is used, whereby the rapid cooling can be advantageously carried out. Further, in addition to commonly known continuous furnace, such an apparatus which can carry out the heat treatment cycle containing a rapid heating and rapid cooling can be used, and there is no limitation in the annealing furnace and means.

The steel sheet which has been subjected to the intermediate annealing containing a rapid heating and rapid cooling, it subjected to final cold rolling. The cold rolling of hot rolled sheet is carried out in at least two times.

The cold rolling is generally carried out in two times, between which an intermediate annealing is carried out at a temperature within the range of 850°-1,050° C., and the first cold rolling is carried out at a reduction rate of about 50-80% and the final cold rolling is carried out at a reduction rate of about 55-75% to produce a finally cold rolled sheet having a final gauge of 0.20-0.35 mm.

The finally cold rolled sheet having a final gauge is subjected to a decarburization annealing. This annealing is carried out in order to convert the cold rolled texture into the primary recrystallized texture and at the same time to remove carbon which is a harmful element for the development of secondary recystallized grains having {110}<001> orientation in the final annealing. The decarburization annealing can be carried out by any commonly known methods, for example, an annealing at a temperature of 750°-850° C. for 3-15 minutes in wet hydrogen.

The final annealing is carried out in order to develop fully secondary recrystallized grains having {110}<001> orientation, and is generally carried out by heating immediately the decarburized steel sheet up to a temperature of not lower than 1,000° C. and keeping the steel sheet to this temperature by a box annealing. This final annealing is generally carried out by a box annealing after an annealing separator, such as magnesia or the like, is applied to the decarburized sheet. However, in the present invention, in order to develop secondary recrystallized grains closely aligned to {110}<001> orientation, it is advantageous to carry out a final annealing by keeping the decarburized sheet at a low temperature within the range of 820°-900° C. Alternatively, the final annealing can be carried out by heating gradually the decarburized sheet at a heating rate of, for example, 0.5°-15° C./hr within the temperature range from 820° C. to 920° C.

The following examples are given for the purpose of illustration of this invention and are not intended as limitations thereof.

EXAMPLE 1

A steel slab having a composition consisting of C: 0.043%, Si: 3.30%, Mn: 0.065%, Se: 0.018%, Sb: 0.025%, and the remainder: Fe, was hot rolled into a thickness of 2.7 mm, and the hot rolled sheet was subjected to a normalizing annealing at 950° C. for 3 minutes, cold rolled at a reduction rate of 70%, and then subjected to an intermediate annealing at 950° C. for 3 minutes.

In this intermediate annealing, the cold rolled sheet was rapidly heated within the temperature range from 500° C. to 900° C. at a heating rate of 20° C./sec, and the steel sheet heated in the intermediate annealing was rapidly cooled within the temperature range from 900° C. to 500° C. at a cooling rate of 25° C./sec. The intermediately annealed sheet was subjected to a final cold rolling at a reduction rate of 63% to produce a finally cold rolled sheet having a final gauge of 0.3 mm. The finally cold rolled sheet was decarburized in wet hydrogen kept at 820° C., and subjected to a secondary recrystallization annealing at 850° C. for 50 hours and then to a purification annealing at 1,180° C. The resulting grain oriented silicon steel sheet had the following magnetic properties.

$B_{10}$: 1.92 T $W_{17/50}$: 1.00 W/kg

EXAMPLE 2

A continuously cast slab having a composition consisting of C: 0.042%, S: 3.29%, Mo: 0.060%, S: 0.020%, Sb: 0.028%, and the remainder: Fe, was hot rolled into a hot rolled sheet having a thickness of 2.7 mm. The hot rolled sheet was subjected to a normalizing annealing at 900° C. for 3 minutes, cold rolled at a reduction rate of about 70% and then subjected to an intermediate annealing at 930° C. for 5 minutes. In this intermediate annealing, the cold rolled sheet was rapidly heated within the temperature range from 500° C. to 900° C. at a heating rate of 30° C./sec, and the steel sheet heated in the intermediate annealing was rapidly cooled within the temperature range from 900° C. to 500° C. at a cooling rate of 35° C./sec. The intermediately annealed sheet was subjected to a second cold rolling at a reduction rate of 63% to produce a finally cold rolled sheet having a final gauge of 0.3 mm. The finally cold rolled sheet was subjected to a decarburization annealing in wet hydrogen kept at 820° C., applied with an annealing separator consisting mainly of MgO, heated from 820° C. to 950° C. at a heating rate of 3° C./hr to develop secondary recrystallized grains, and successively subjected to a purification annealing at 1,180° C. for 5 hours in hydrogen. The resulting product had the following magnetic properties.

$B_{10}$: 1.91 T $W_{17/50}$: 1.04 W/kg

EXAMPLE 3

A hot rolled sheet of 2.4 mm thickness having a composition consisting of C: 0.043%, Si: 3.25%, Mn: 0.062%, S: 0.020%, and the remainder: Fe, was subjected to a normalizing annealing at 900° C. for 5 minutes, and then subjected to two cold rollings with an intermediate annealing at 950° C. for 3 minutes between them to produce a finally cold rolled sheet having a final gauge of 0.30 mm. In this intermediate annealing, the first cold rolled sheet was rapidly heated within the temperature range from 500° C. to 900° C. at a heating rate of 25° C./sec, and the steel sheet heated in the intermediate annealing was rapidly cooled within the temperature range from 900° C. to 500° C. at a cooling rate of 25° C./sec.

The finally cold rolled sheet was subjected to a decarburization annealing in wet hydrogen kept at 800° C., applied on its surface with an annealing separator consisting mainly of MgO, heated from 820° C. to 1,000° C. at a heating rate of 5° C./hr to develop secondary recrystallized grains, and then subjected to a purification annealing at 1,200° C. for 5 hours. The resulting product had the following magnetic properties.

$B_{10}$: 1.90 T $W_{17/50}$: 1.10 W/kg

EXAMPLE 4

A continuously cast slab having a composition consisting of C: 0.045%, Si: 3.19%, Mn: 0.055%, S: 0.020%, and the remainder: Fe, was hot rolled, and the hot rolled sheet was subjected to a first cold rolling at a reduction rate of about 65%. The first cold rolled sheet was subjected to an intermediate annealing at 950° C. for 3 minutes. In this intermediate annealing, the heating of the first cold rolled sheet from 500° C. to 900° C. was effect at a heating rate of 35° C./sec, and the steel sheet heated in the intermediate annealing was rapidly cooled within the temperature range from 900° C. to 500° C. at a cooling rate of 35° C./sec. The intermediately annealed sheet was subjected to a second cold rolling to produce a finally cold rolled sheet having a final gauge of 0.3 mm. The finally cold rolled sheet was subjected to a decarburization annealing in wet hydrogen kept at 800° C., heated from 800° C. to 1,000° C. at a heating rate of 5° C./hr to develop secondary recrystallized grains, and then subjected to a purification annealing at 1,180° C. for 5 hours. The resulting product had the following magnetic properties.

$B_{10}$: 1.90 T $W_{17/50}$: 1.09 W/kg

EXAMPLE 5

A steel ingot having a composition consisting of C: 0.042%, Si: 3.30%, Mn: 0.065%, Se: 0.018%, and the remainder: Fe, was hot rolled into a thickness of 2.3 mm, and the hot rolled sheet was subjected to a normalizing annealing at 915° C. for 3 minutes. Then, the steel sheet was subjected to two cold rollings with an intermediate annealing at 900° C. for 3 minutes between them to produce a finally cold rolled sheet having a final gauge of 0.3 mm.

In this intermediate annealing, the first cold rolled sheet was rapidly heated within the temperature range from 500° C. to 900° C. at a heating rate of 20° C./sec, and the steel sheet heated in the intermediate annealing was rapidly cooled within the temperature range from 900° C. to 500° C. at a cooling rate of 20° C./sec.

The finally cold rolled sheet was subjected to a decarburization annealing in wet hydrogen kept at 820° C., applied on its surface with an annealing separator consisting of MgO, subjected to a secondary recrystallization annealing at 860° C. for 40 hours in nitrogen gas, and further subjected to a purification annealing at 1,200° C. for 5 hours. The resulting product had the following magnetic properties.

$B_{10}$: 1.91 T $W_{17/50}$: 1.03 W/kg

EXAMPLE 6

A continuously cast slab having a composition containing Si: 3.30%, C: 0.043%, Mn: 0.068%, Mo; 0.015%, Se: 0.020%, and Sb: 0.025%, was hot rolled into a thickness of 2.4 mm, and the hot rolled sheet was subjected to a normalizing annealing at 900° C. for 5 minutes, and further subjected to two cold rolling with an intermediate annealing at 950° C. for 3 minutes between them.

In the intermediate annealing, the first cold rolled sheet was rapidly heated within the temperature range from 500° C. to 900° C. at a heating rate of 13° C./sec, and the steel sheet heated in the intermediate annealing was rapidly cooled within the temperature range from 900° C. to 500° C. at a cooling rate of 20° C./sec. The intermediately annealed sheet was finally cold rolled at a reduction rate of 65% into a final gauge of 0.23 mm. The finally cold rolled sheet was decarburized in wet hydrogen kept at 820° C., subjected to a secondary recrystallization annealing at 850° C. for 50 hours and further subjected to a purification annealing at 1,180° C. for 7 hours. The resulting product had the following magnetic properties.

$B_{10}$: 1.91 T $W_{17/50}$: 0.85 W/kg

EXAMPLE 7

A steel ingot having a composition containing S: 3.33%, C: 0.043%, Mn: 0.068%, Se: 0.017%, Sb: 0.023% and Mo: 0.013%, was hot rolled into a thickness of 2.7 mm, and the hot rolled sheet was subjected to a normalizing annealing at 950° C. for 3 minutes, cold rolled at a reduction rate of 70%, and then subjected to an intermediate annealing at 950° C. for 3 minutes.

In this intermediate annealing, the cold rolled sheet was rapidly heated within the temperature range from 500° C. to 900° C. at a heating rate of 15° C./sec, and the steel sheet heated in the intermediate annealing was rapidly cooled within the temperature range from 900° C. to 500° C. at a cooling rate of 22° C./sec. The intermediately annealed sheet was subjected to a final cold rolling at a reduction rate of 65% to produce a finally cold rolled sheet having a final gauge of 0.27 mm. The finally cold rolled sheet was decarburized in wet hydrogen kept at 820° C., subjected to a secondary recrystallization annealing at 850° C. for 50 hours, and further subjected to a purification annealing at 1,180° C. The resulting product had the following magnetic properties.

$B_{10}$: 1.92 T $W_{17/50}$: 0.94 W/kg

EXAMPLE 8

A continuously cast slab having a composition containing Si: 3.35%, C: 0.045%, Mn: 0.066%, Se: 0.016%, Sb: 0.025% and Mo: 0.015%, was hot rolled to produce a hot rolled sheet having a thickness of 2.7 mm, and the hot rolled sheet was subjected to a normalizing annealing at 900° C. for 3 minutes, cold rolled at a reduction rate of about 70% and then subjected to an intermediate annealing at 950° C. for 3 minutes.

In this intermediate annealing, the cold rolled sheet was rapidly heated within the temperature range from 500° C. to 900° C. at a heating rate of 25° C./sec, and the steel sheet heated in the intermediate annealing was rapidly cooled within the temperature range from 900° C. to 500° C. at a cooling rate of 30° C./sec. The intermediately annealed sheet was subjected to a second cold rolling at a reduction rate of 65% to produce a finally cold rolled sheet having a final gauge of 0.3 mm. The finally cold rolled sheet was subjected to a decarburization annealing, subjected to a secondary recyrstallization annealing at 850° C. for 50 hours, and further subjected to a purification annealing at 1,200° C. for 5 hours in hydrogen. The resulting product had the following magnetic properties.

$B_{10}$: 1.93 T $W_{17/50}$: 0.96 W/kg

EXAMPLE 9

A hot rolled steel sheet of 2.4 mm thickness having a composition containing Si: 3.30%, C: 0.043%, Mn: 0.068%, S: 0.018%, Sb: 0.025% and Mo: 0.015%, was subjected to a normalizing annealing at 900° C. for 5 minutes, and then subjected to two cold rollings with an intermediate annealing at 950° C. for 3 minutes between them to produce a finally cold rolled sheet having a final gauge of 0.30 mm. In this intermediate annealing, the first cold rolled sheet was rapidly heated within the temperature range from 500° C. to 900° C. at a heating rate of 35° C./sec, and the steel sheet heated in the intermediate annealing was rapidly cooled within the temperature range from 900° C. to 500° C. at a cooling rate of 35° C./sec.

The finally cold rolled sheet was subjected to a decarburization annealing and then to a secondary recrystallization annealing at 850° C. for 50 hours, and further subjected to a purification annealing at 1,200° C. for 5 hours. The resulting product had the following magnetic properties.

$B_{10}$: 1.92 T $W_{17/50}$: 1.00 W/kg

EXAMPLE 10

A hot rolled steel sheet of 3.0 mm thickness having a composition containing Si: 3.38%, C: 0.049%, Mn: 0.078%, S: 0.029%, acid-soluble Al: 0.028% and N: 0.0072%, was continuously annealed at 1,150° C., and then subjected to a rapidly cooling treatment. Then, the steel sheet was subjected to two cold rollings with an intermediate annealing at 950° C. for 3 minutes between them to produce a finally cold rolled sheet having a final gauge of 0.30 mm. In this intermediate annealing, the first cold rolled sheet was rapidly heated within the temperature range from 500° C. to 900° C. at a heating rate of 30° C./sec, and the steel sheet heated in the intermediate annealing was rapidly cooled within the temperature range from 900° C. to 500° C. at a cooling rate of 30° C./sec. The finally cold rolled sheet was subjected to a decarburization annealing in wet hydrogen kept at 850° C., and then to a final annealing at 1,200° C. to obtain a final product. The product had the following magnetic properties.

$B_{10}$: 1.97 T $W_{17/50}$: 0.95 W/kg

EXAMPLE 11

A continuously cast slab having a composition containing Si: 3.21%, C: 0.044%, Mn: 0.058%, S: 0.025%, B: 0.0018% and Cu: 0.35%, was hot rolled to produce a hot rolled sheet having a thickness of 2.8 mm. The hot rolled sheet was subjected to a normalizing annealing at 950° C. for 3 minutes, and then to two cold rollings with an intermediate annealing at 950° C. between them to produce a finally cold rolled sheet having a final gauge of 0.30 mm. In this intermediate annealing, the first cold rolled sheet was rapidly heated within the temperature range from 500° C. to 900° C. at a heating rate of 25° C./sec, and the steel sheet heated in the intermediate annealing was rapidly cooled within the temperature range from 900° C. to 500° C. at a cooling rate of 35° C./sec. The finally cold rolled sheet was subjected to a decarburization annealing in wet hydrogen kept at 830° C., and then to a final annealing at 1,200° C. to produce a final product. The product had the following magnetic properties.

$B_{10}$: 1.94 T $W_{17/50}$: 0.98 W/kg

EXAMPLE 12

A continuously cast slab having a composition containing Si: 3.21%, C: 0.045%, Mn: 0.072%, S: 0.021%, Al: 0.022%, and N: 0.0068%, was hot rolled to produce a hot rolled sheet having a thickness of 2.7 mm. The hot rolled sheet was subjected to a normalizing annealing at 1,000° C. for 3 minutes and then rapidly cooled from 1,000° C. to 400° C. at a cooling rate of 10° C./sec. Then, the steel sheet was subjected to a first cold rolling at a reduction rate of about 40–50% and a second cold rolling at a reduction rate of about 75–85%, between which an intermediate annealing was effected at 950° C. for 3 minutes, to produce a finally cold rolled sheet having a final gauge of 0.30 mm. In this intermediate annealing, the rapidly heating rate was controlled to 30° C./sec, and the rapidly cooling rate was controlled to 35° C./sec. The finally cold rolled sheet was subjected to a decarburization and primary recrystallization annealing, heated from 820° C. to 1,050° C. at a heating rate of 5° C./hr, and then subjected to a purification annealing at 1,200° C. for 8 hours in hydrogen. The resulting product had the following magnetic properties.

$B_{10}$: 1.94 T $W_{17/50}$: 1.00 W/kg

EXAMPLE 13

A continuously cast slab having a composition containing Si: 3.30%, C: 0.048%, Mn: 0.076%, S: 0.018%, Al: 0.025%, N: 0.0058%, and Sn: 0.15%, was hot rolled to produce a hot rolled sheet having a thickness of 2.0 mm, and the hot rolled sheet was subjected to a normalizing annealing at 1,000° C. for 3 minutes and then rapidly cooled from 1,000° C. to 400° C. at a cooling rate of 10° C./sec. The rapidly cooled sheet was subjected to a first cold rolling at a reduction rate of about 50–60% and a second cold rolling at a reduction rate of about 70–75%, between which an intermediate annealing was effected at 950° C. for 3 minutes, to produce a finally cold rolled sheet having a final gauge of 0.23 mm. In this intermediate annealing, the rapidly heating rate was controlled to 25° C./sec, and the rapidly cooling rate was controlled to 30° C./sec.

The finally cold rolled sheet was subjected to a decarburization and primary recrystallization annealing, heated from 820° C. to 1,050° C. at a heating rate of 5° C./hr, and then subjected to a purification annealing at 1,200° C. for 5 hours in hydrogen. The resulting product had the following magnetic properties.

$B_{10}$: 1.95 T $W_{17/50}$: 0.78 W/kg

What is claimed is:

1. In a method of producing grain oriented silicon steel sheets or strips having high magnetic induction and low iron loss, wherein a silicon steel slab having a composition consisting of 0.01–0.06% by weight of C, 2.0–4.0% by weight of Si, 0.01–0.20% by weight of Mn, 0.005–0.1% by weight in a total amount of at least one of S and Se, and the remainder being substantially Fe is hot rolled, the hot rolled sheet is subjected to a normalizing annealing and then subjected to at least two cold rollings with an intermediate annealing between them to produce a cold rolled sheet having a final gauge, and the cold rolled sheet is subjected to a primary recrystallization annealing concurrently effecting decarburization and then subjected to a final annealing to develop secondary recrystallized grains having {110}<001> orientation, the improvement comprising carrying out such rapid heating and rapid cooling treatments in the intermediate annealing that heating from 500° C. to 900° C. of the first cold rolled sheet is carried out at a heating rate of at least 5° C./sec, and cooling from 900° C. to 500° C. of the steel sheet heated in the intermediate annealing is carried out at a cooling rate of at least 5° C./sec.

2. A method according to claim 1, wherein the heating rate is at least 10° C./sec and the cooling rate is at least 10° C./sec.

3. A method according to claim 1 or 2, wherein the slab further contains 0.005–0.20% by weight of Sb.

4. A method according to claim 1 or 2, wherein the slab further contains 0.005–0.20% by weight of Sb and 0.003–0.1% by weight of Mo.

5. A method according to claim 1 or 2, wherein the slab further contains 0.01–0.09% by weight of acid-soluble Al and 0.001–0.01% by weight of N.

6. A method according to claim 1 or 2, wherein the slab further contains 0.01–0.09% by weight of acid-soluble Al, 0.005–0.5% by weight of Sn and 0.001–0.01% by weight of N.

7. A method according to claim 1 or 2, wherein the slab further contains 0.0003–0.005% by weight of B and 0.005–0.5% by weight of Cu.

* * * * *